United States Patent [19]

Kondracki

[11] 4,274,228

[45] Jun. 23, 1981

[54] WINDOW GATE CONSTRUCTION

[75] Inventor: Witold Kondracki, New York, N.Y.

[73] Assignee: Manhattan Protection, Inc., New York, N.Y.

[21] Appl. No.: 81,568

[22] Filed: Oct. 3, 1979

[51] Int. Cl.[3] ..... E06B 3/68

[52] U.S. Cl. ..... 49/56; 49/394; 292/60; 292/DIG. 63

[58] Field of Search ..... 49/56, 50, 67, 394; 292/57, 60, 59, DIG. 63

[56] References Cited

U.S. PATENT DOCUMENTS

| | | | |
|---|---|---|---|
| 1,770,751 | 7/1930 | Hall | 292/57 |
| 2,711,565 | 6/1955 | Levin | 49/56 X |
| 4,055,360 | 10/1971 | Russi | 49/56 X |
| 4,111,472 | 9/1978 | Smith et al. | 49/56 X |

*Primary Examiner*—Philip C. Kannan
*Attorney, Agent, or Firm*—Charles E. Temko

[57] ABSTRACT

A metallic anti-intruder type gate, particularly adapted for use in windows offering access to a fire escape. The gate includes an outer frame element permanently installed within a window frame, and a hinged gate element supported by the frame and maintained in locked position relative thereto by a sliding bolt. The door is formed to include a rectangular peripheral frame and metal lattice which avoids adequate ventilation and light consistent with mechanical strength. The sliding bolt is shielded to permit access thereto for operation only from that side of the door facing the interior of the building in which it is installed.

4 Claims, 3 Drawing Figures

WINDOW GATE CONSTRUCTION

BACKGROUND OF THE INVENTION

This invention relates generally to the field of window gates for protection against intruders, and more particularly to an improved form thereof adapted to be used in those windows of a tenement or similar structure adjacent a fire escape.

Devices of this type are widely used in urban areas, particularly in windows located on the ground floor level to foil intruders seeking unauthorized entry. Above the ground floor, such devices are used principally in those windows leading to a fire escape or similar exit, since they are the only windows normally offering access to an intruder. In such installations, the gate must offer the occupants of the building provision for rapid opening in the event of a fire or other emergencies. Such requirement precludes the use of key-type locks, and simple latching means employing a striker can usually be overcome from the exterior side of the gate owing to the presence of openings in the plane thereof which afford light and ventilation.

The most commonly used installation is the so-called Lazy Tong type which may be folded to one side of the window opening to provide access therethrough when the gate is opened. In such construction, if the locking means is easily manipulatable, it can be manually opened by an intruder. If it is difficult to open, it interferes with ready access by an exiting occupant.

SUMMARY OF THE INVENTION

Briefly stated, the invention contemplates the provision of an improved security gate of the class described, in which the above mentioned difficulties have been substantially eliminated. The inventive construction employs a rectangular outer frame which is securely fixed within a window opening adjacent the interior side of the sash. A door-like gate member is hingedly supported within the opening in the frame to be secured in coplanar relation by a single sliding bolt. The bolt is supported within a box-like housing, whereby access to the bolt handle is available only from the interior side of the gate, the housing preventing the insertion of the hand or fingers of an intruder through the plane of the gate to engage the bolt handle. The housing includes an internal septum limiting movement of the fingers of the user therewithin necessary to move the bolt to retracted position, it being impossible to manipulate the bolt against the resilient action of a spring tending to move the bolt to closed condition unless the entire hand of the user is adjacent an inner surface of the housing.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 2:
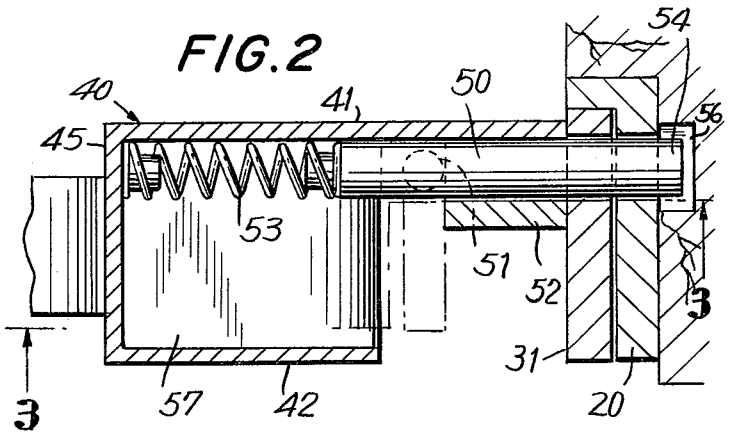
FIG. 2 is an enlarged fragmentary sectional view as seen from the plane 2—2 in FIG. 1.
Figure 3:
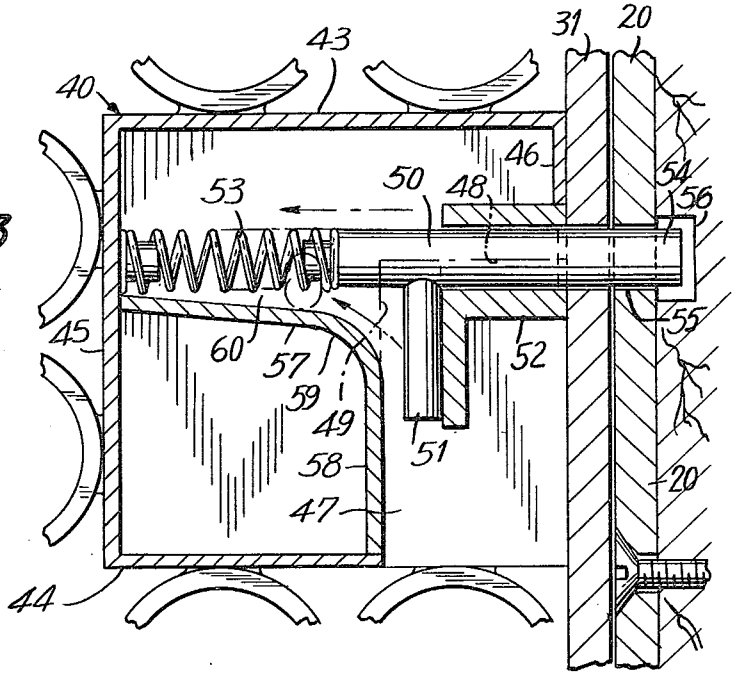
FIG. 3 is an enlarged fragmentary sectional view as seen from the plane 3—3 in FIG. 2.

In accordance with the invention, the device, generally indicated by reference character 10, comprises broadly: an outer frame element 11, a locking means 13.

The outer frame element 11 is preferably formed from heavy-duty angle iron, suitably welded at the corners thereof. It includes an upper peripheral member 18, a pair of side members 19 and 20, and a lower member 21, the outer surfaces of which are abutted to and interconnected with the edges of a window opening (not shown) in well known manner.

The gate element 12 is most suitably constructed from welded strap iron, and is boarded by an upper horizontal member 28, a lower horizontal member 29, and first and second vertical members 30 and 31, respectively. Hinges 32 and 33 pivotally interconnect the first vertical member 30 with the corresponding side member 19 of the outer frame element 11. A plurality of lattice work members 34, which may be oriented to form an attractive design, interconnect with the members 28-31 inclusive, and provide openings 35 for the passage of light and air.

The locking means 13, consistent with easy manipulation by a user, comprises a single locking bolt. This is disposed within a box-like housing 40 welded to the inner surface of the gate element 12. The housing includes an outer wall 41, an inner wall 42, an upper wall 43, a lower wall 44, and side walls 45 and 46. An opening 47 is formed at one corner of the inner wall 42 and is bounded by an upper edge 48 and a side edge 49. The bolt 50 includes an operating handle 51 and is supported by a bolt slide 52. A bolt spring 53 urges a first outer end 54 of the bolt into a corresponding bolt receiving means 55 in the side member 20. A curved septum 57, including a vertical portion 58 and angularly disposed member 59 forms a realtively limited space 60 communicating with the opening 47.

The septum is secured to the inner surface of the inner wall 42, and does not extend to the outer wall 41, so as to provide adequate space for the handle 51 of the bolt 50 when withdrawn.

Figure 1:
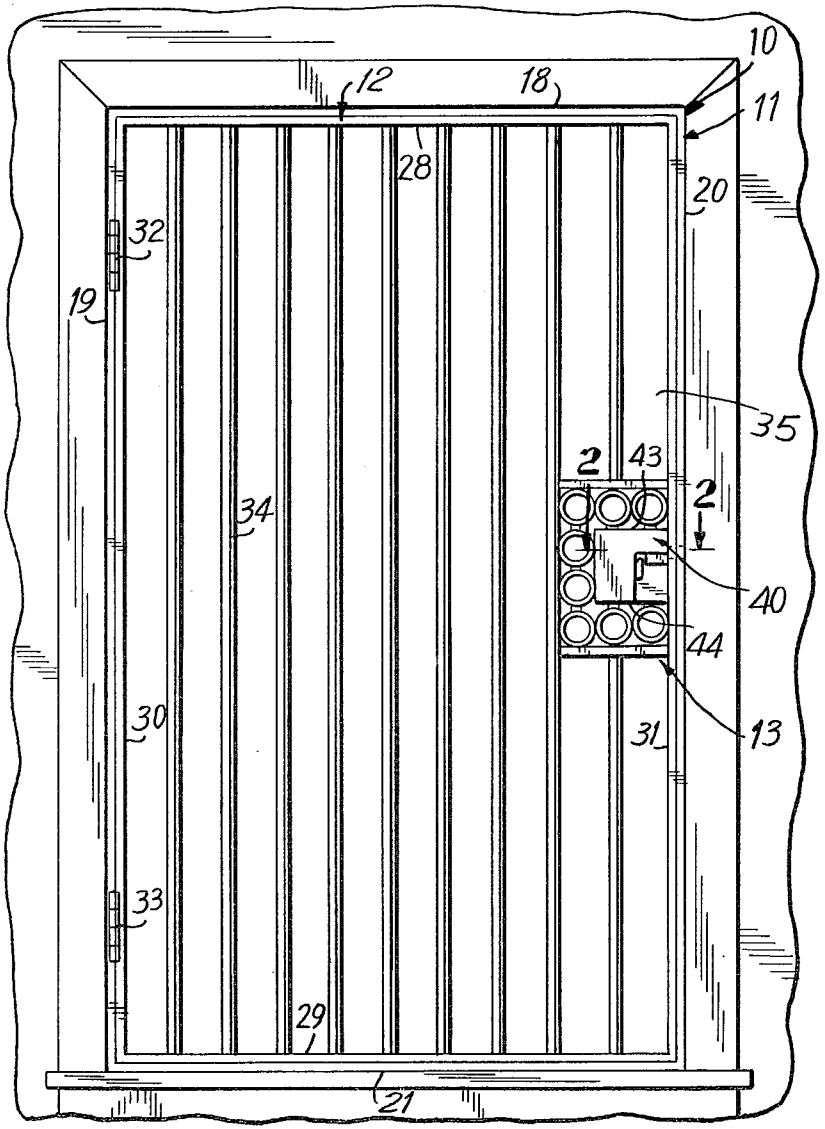
FIG. 1 is a fragmentary side elevational view of an embodiment of the invention in installed condition within a window opening.

It will be apparent from a consideration of the drawing, particularly FIG. 1, that the opening 47 is not readily accessible through the openings 35 in the gate element 12, either by the fingers of an intruder, or any tool that can be manually positioned from the exterior of the gate element. The spring 53 will normally urge the bolt 50 outwardly, so that when the bolt receiving means 55 is aligned, the gate element will normally be locked. The movement of the bolt handle 50 into the recess 56 will normally complete this engagement.

To unlock the gate element, it is necessary to manually lift the handle 51 to disengage the bolt 50 from the recess 56, and move the same away from the receiving means 55 against the action of the spring 53. If the handle 51 has been rotated just sufficiently to clear the means 56, it will strike the portion 59 of the spetum 57, necessitating further manual rotation upwardly while simultaneously moving the bolt to open condition. This manipulation can be accomplished only by inserting the fingers of the user to contact the handle, and simultaneously rotate and move the handle in the above direction. The space permitted by the spetum 57 is just that necessary to allow the insertion of a few of the fingers of the user. While this movement can be performed easily, substantial effort is required, using the movement of the fingers involving both rotational and translational components, a movement which cannot be readily accomplished using any known form of jimmying or similar tool. Should the bolt handle slip from engagement with the fingers of the user, the spring will immediately return the bolt to locked condition, and the operation must be again started. It is this provision which prevents the use of any means other than the fingers of the user to accomplish disengagement.

Once the bolt has been withdrawn, it is manually maintained in this position while the gate is swung open to permit egress through the window.

Mention is made of the fact that the outer frame element 11, once secured within a window opening, is not readily disengaged, owing to the fact that retaining bolts (not shown) are normally concealed by the presence of the gate element 12 when in closed condition.

It may thus be seen that I have invented novel and highly useful improvements in security type gate construction, particularly adapted for use in windows providing access to fire escapes or routes leading thereto. Although only a single simple bolt means is provided to maintain the gate in closed condition, access to the bolt from the outside of the gate is prevented by the presence of a shielding housing which provides only limited access from the interior side thereof. The gate, nevertheless, may be formed to include welded lattice work providing adequate passage of both light and fresh air, normally imperative to gates of this type. Because of the elimination of conventional Lazy Tong construction, the gate is far more rigid than typical prior art constructions, and less susceptible to damage.

I wish it to be understood that I do not consider the invention limited to the precise details of the structure shown and set forth in this specification, for obvious modifications will occur to those skilled in the art to which the invention pertains.

I claim:

1. In an improved security gate construction including a relatively fixed rectangular frame element adapted to be secured within a window opening, a rectangular foraminous gate element hingedly supported by said frame element for relative movement, and means for selectively fixing the position of said gate element in coplanar position relative to said frame element, the improvement in said last mentioned means comprising: a box-like housing secured to a first surface of said gate element, said housing including a plurality of walls defining an enclosure, and having an opening in at least one of said walls permitting limited access to said enclosure, said opening being positioned adjacent a free edge of said gate element, and configured to prevent manual access thereto from an oppositely disposed second surface of said gate element; bolt receiving means on said frame element, an elongated bolt in said housing having a first end selectively engaging said bolt receiving means to effect a locking function; means on said housing for supporting said bolt for sliding movement, resilient means continuously urging said bolt into engagement with said bolt receiving means; a bolt handle extending laterally from said bolt adjacent a second end thereof, said handle being moved interiorly of said housing upon moving said bolt to disengaged condition with respect to said bolt receiving means.

2. The improvement as set forth in claim 1, further characterized in the provision of a septum subdividing the interior of said housing and forming a chamber into which the fingers of a user are insertable during manual engagement of said bolt handle and withdrawal of said bolt from engagement with said bolt receiving means.

3. The improvement in accordance with claim 2, further characterized in the provision of a curved septum on said housing element engaging said bolt handle upon axial rotation of said bolt following engagement of said first end thereof with said bolt receiving means.

4. The improvement in accordance with claim 3, further characterized in the interior of said housing being so configured that said bolt handle upon disengagement from said curved septum must be further rotated through a substantial arc prior to withdrawal from said bolt receiving means.

* * * * *